US005791529A

United States Patent [19]

Mukai

[11] Patent Number: 5,791,529

[45] Date of Patent: Aug. 11, 1998

[54] SUPPLEMENTAL MOUTHPIECE FOR A LIQUID BOTTLE

[75] Inventor: Yasuo Mukai, Tokyo, Japan

[73] Assignee: Kabushiki Kaisha Sawa, Tokyo, Japan

[21] Appl. No.: 735,393

[22] Filed: Oct. 21, 1996

[30] Foreign Application Priority Data

Oct. 17, 1996 [JP] Japan ..... 8-295768

[51] Int. Cl.[6] ..... B67D 3/00

[52] U.S. Cl. ..... 222/478; 222/479

[58] Field of Search ..... 222/478, 479, 222/481.5, 570

[56] References Cited

U.S. PATENT DOCUMENTS

| | | | |
|---|---|---|---|
| 171,165 | 12/1875 | Perkins | 222/478 |
| 3,410,459 | 11/1968 | Conley | 222/479 |
| 3,595,421 | 7/1971 | Sanchis | 222/479 X |
| 3,966,099 | 6/1976 | Sanford, Jr. et al. | 222/478 |
| 4,509,665 | 4/1985 | Goodall | 222/478 |
| 4,838,464 | 6/1989 | Briggs | 222/478 |
| 5,199,613 | 4/1993 | Magrath et al. | 222/478 X |
| 5,377,882 | 1/1995 | Pham et al. | 222/479 |

FOREIGN PATENT DOCUMENTS

| | | | |
|---|---|---|---|
| 2631935 | 12/1989 | France | 222/478 |
| 1172137 | 6/1964 | Germany | 222/479 |
| 2356685 | 5/1974 | Germany | 222/479 |
| 1349530 | 4/1974 | United Kingdom | 222/478 |
| WO 84/01938 | 5/1984 | WIPO | 222/479 |

*Primary Examiner*—Kevin P. Shaver

*Attorney, Agent, or Firm*—Cushman Darby Cushman Intellectual Property Group of Pillsbury Madison & Sutro LLP

[57] ABSTRACT

This invention is related to a supplemental mouthpiece which is adapted to be mounted on the mouth portion of a liquid bottle and provided with a partitioning strip extending into the interior of the bottle. The cap for the bottle can be mounted while the supplemental mouthpiece is left attached to the mouth portion. According to this supplemental mouthpiece, the partitioning strip is mounted on the mouth portion to partition the interior thereof and one of the partitioned passage is covered by a cover provided with a vent hole to prevent the splashing of liquid and at the same time to prevent the liquid from pouring out from the covered passage. The cover may be formed integral with the mouth portion, or with a securing member which is adapted to be mounted on the mouth portion, thereby allowing the cover to be detachably mounted on the mouth portion.

7 Claims, 6 Drawing Sheets

SUPPLEMENTAL MOUTHPIECE FOR A LIQUID BOTTLE

BACKGROUND OF THE INVENTION (a). Field of the Invention

This invention relates to a supplemental mouthpiece for a liquid bottle, and in particular to a supplemental mouthpiece for a liquid bottle, which is integrally formed with the mouth portion of the bottle or detachably mounted on the mouth portion of the bottle for inhibiting the spattering or splashing of liquid at the moment of pouring the liquid out of the liquid bottle.

(b). Description of Related Art

Japanese Utility Model Unexamined Publication Hei/6-80645 discloses a liquid bottle provided with a mouth which is constructed such that the spouting or splashing of liquid from the bottle can be prevented as the liquid in a liquid bottle is to be poured out of the bottle. Specifically, this Japanese Utility Model Unexamined Publication discloses a supplemental mouthpiece which comprises an annular fixing portion which is adapted to be mounted over a cylindrical mouthpiece of a bottle, a cylindrical discharge port extending outward from the upper portion of the annular fixing portion, and a partitioning strip formed in the cylindrical mouthpiece longitudinally partitioning the interior of the cylindrical mouthpiece whereby forming an air suction passage on one side of the partitioning strip and a pouring passage of liquid on the other side of the partitioning strip. In this case, the partitioning strip functions to prevent the pulsatory motion of liquid as the liquid is poured out of the bottle.

However, since this supplemental mouthpiece is cylindrical in shape and a partitioning strip is formed in this cylindrical portion, it is impossible, once the supplemental mouthpiece is mounted on the mouth portion of the bottle, to put the cap of the bottle back to the mouth portion of the bottle for sealing the mouth portion of the bottle.

There is also proposed a mouthpiece in Japanese Utility Model Unexamined Publication Hei/2-85154, which comprises a suction tube attached in close to the inner periphery of a bottle mouth, the distal portion of the suction tube extending into the interior of the bottle. According to this Japanese Utility Model Unexamined Publication, the suction tube is utilized for preventing the splashing or pulsating motion of liquid in a pouring of the liquid. However, since this mouthpiece is not provided with a partitioning strip, it would be very difficult to effectively inhibit the splashing or pulsating motion of liquid.

SUMMARY OF THE INVENTION

Accordingly, a main object of the present invention is to provide a supplemental mouthpiece for a liquid bottle, which is capable of allowing the cap of the bottle to be put back to the mouth portion of the bottle while the supplemental mouthpiece is being kept mounted on the mouth or mouthpiece of the liquid bottle.

The aforementioned object has been accomplished in this invention by providing a supplemental mouthpiece for a liquid bottle, which is featured in that the supplemental mouthpiece is provided with a partitioning strip which is adapted to extend into mouth portion of a bottle thereby to partition the interior of the mouth portion into two passage sections, one of which being closed by a cover provided with a vent hole thereby preventing a splashing of liquid as the liquid is poured out of the bottle while allowing the liquid to be discharged only through the other passage section.

This supplemental mouthpiece may be integrally formed with the mouth portion of a liquid bottle.

Specifically, according to one aspect of this invention, there is provided a supplemental mouthpiece integrally formed with a liquid bottle and comprising a cover partially closing an opening of the mouth portion of the bottle, a vent hole formed in said cover, and a partitioning strip attached to and extending perpendicularly from an edge of the cover toward the interior of the bottle so as to partition an interior of the mouth portion into two passage sections.

According to another aspect of this invention, this supplemental mouthpiece may be integrally formed with a securing member which is adapted to be detachably mounted on the mouth portion of a liquid bottle.

The cover may be of approximately semicircular in shape and the securing member is formed along the outer periphery of the arched portion of the cover.

The cover may be of approximately semicircular in shape and the partitioning strip is formed along a straight diametrical edge of said semicircular cover and extending perpendicularly from the straight diametrical edge toward the interior of the bottle.

The cover may be provided with a protection piece covering over the vent hole for preventing liquid from flowing out through the vent hole while allowing air to pass through the vent hole The securing member may be provided with a groove to be fitted in snugly with the upper edge of the mouthpiece of the liquid bottle.

The securing member may be an annular member to be fitted in snugly with the upper annular edge of the mouth portion of the liquid bottle.

Figure 5:
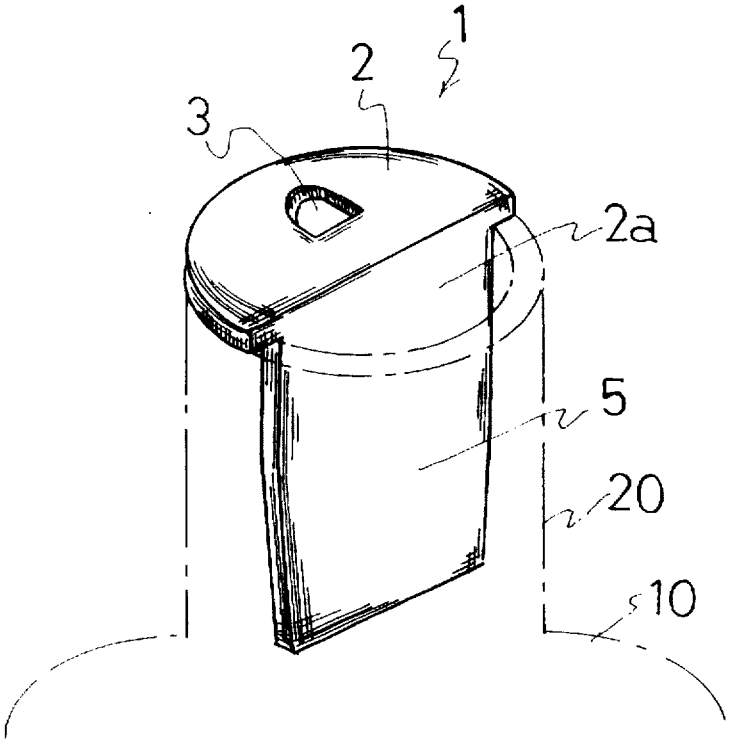
Figure 6:
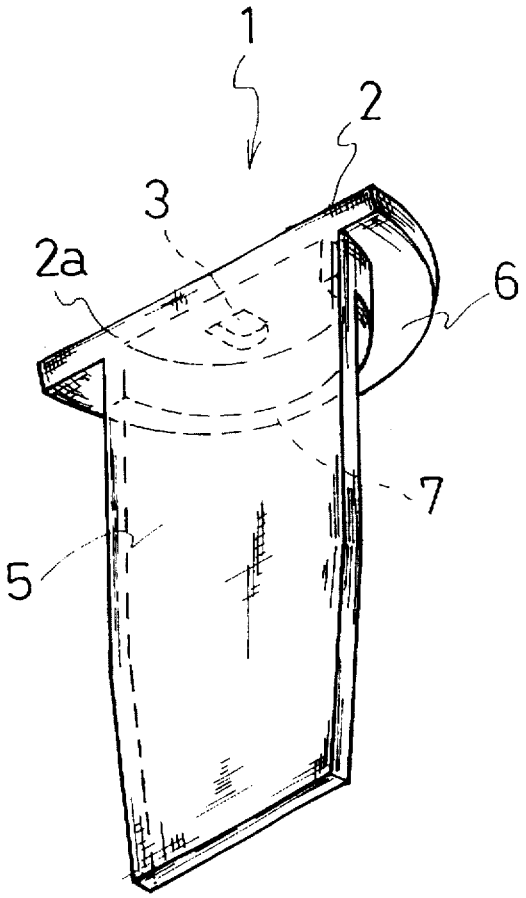
Figure 7:
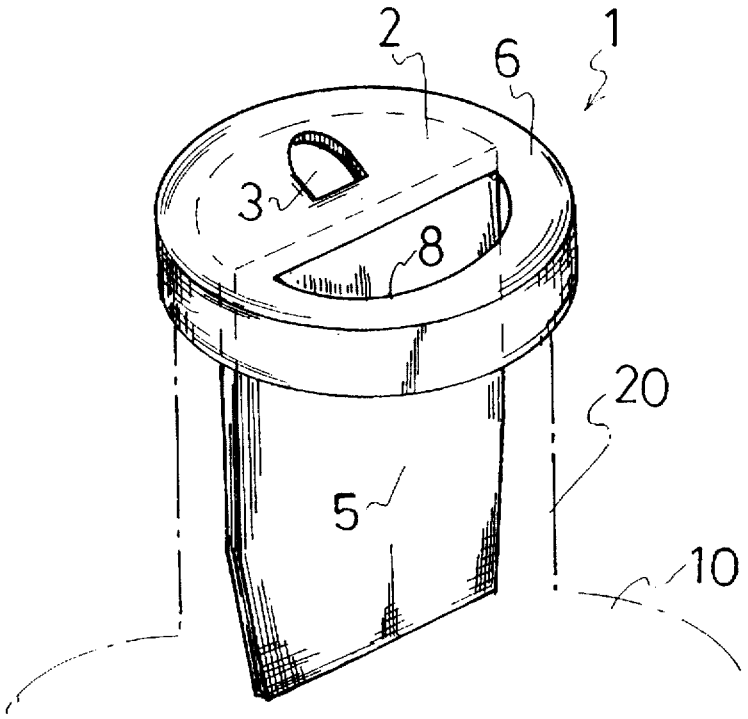

The FIG. 5 is a perspective view of a supplemental mouthpiece for a liquid bottle according to a third embodiment of this invention;

FIG. 6 is a perspective view of the supplemental mouthpiece shown in FIG. 5 as it is viewed from a different angle from that of FIG. 5; and FIG. 7 is a perspective view of a supplemental mouthpiece for a liquid bottle according to a fourth embodiment of this invention.

DESCRIPTION OF THE PREFERRED EMBODIMENTS

This invention will be explained further with reference to the drawings illustrating a supplemental mouthpiece for a liquid bottle made of PET (polyethylene terephthalate resin).

Figure 1:
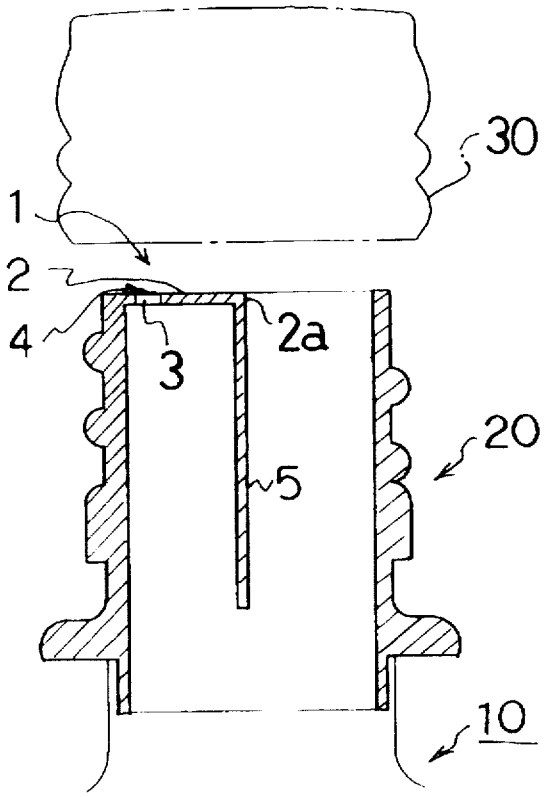
FIG. 1 is a cross-sectional view of a supplemental mouthpiece for a liquid bottle according to a first embodiment of this invention.
Figure 2:
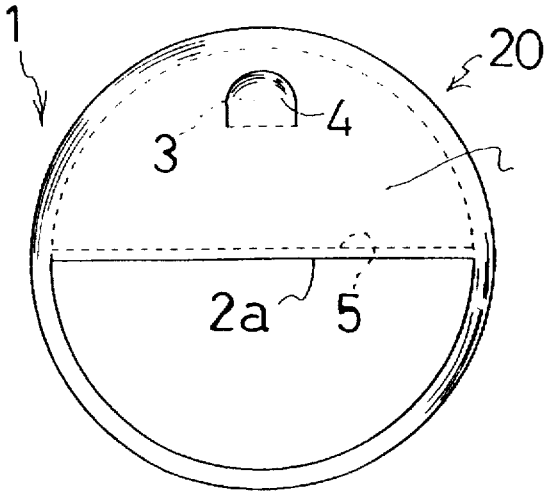
FIG. 2 is a plan view of the supplemental mouthpiece shown in FIG. 1.

Referring to FIGS. 1 and 2, the supplemental mouthpiece shown therein illustrates a first embodiment wherein the supplemental mouthpiece 1 is integrally formed with a mouth portion 20 of a liquid bottle 10 made of PET. The mouth portion 20 is cylindrical in shape and provided on its outer wall with a male screw which is adapted to be engaged with a cap 30. The mouth portion 20 is prepared in separate from the main body of the liquid bottle 10, and subsequently attached to the top portion of the liquid bottle 10. The supplemental mouthpiece 1 is formed of synthetic resin, L-shaped in cross-section and integrally formed with the mouth portion 20 in such a manner that a portion of the top opening of the mouth portion 20 is closed by the cover 2 constituting the supplemental mouthpiece 1.

Specifically, the cover 2 in this embodiment is approximately semicircular in shape, partially covering a circular top opening of the mouth portion 20. However, there is not any particular limitation regarding the shape of the cover 2. For instance, the cover 2 may be fan-shaped or any other shape as long as it is capable of partially closing the top opening of the mouth portion 20.

The cover 2 is provided with a through opening constituting a vent hole 3. This vent hole 3 should preferably be formed at a portion of the cover 2 which is located remotest from a partitioning strip 5 to be explained later. This vent hole 3 functions to introduce air into the interior of the bottle so as to minimize any difference in pressure between the inside and outside of the bottle. The vent hole 3 may be provided with a protection piece 4 covering over the vent hole 3 for preventing liquid from flowing out through the vent hole 3 while allowing air to pass through the vent hole 3. This protection piece 4 may be formed concurrently with the formation of the vent hole 3, i.e. a portion of the cover 2 is incompletely cut and then the cut portion is raised to form a through hole constituting the vent hole 3, the raised portion of the cover 2 being utilized as the protection piece 4.

The partitioning strip 5 is integrally formed with the cover 2 in such a manner that the partitioning strip 5 extends perpendicularly from the straight side edge 2*a* of the cover 2 toward the interior of the bottle 10 so as to longitudinally partition an interior of the mouthpiece into two passage sections. In the example shown in FIG. 1, the partitioning strip 5 extends throughout approximately full length of the mouth portion 20.

The both side edges of the partitioning strip 5 may be connected with the inner wall of the mouth portion 20, or may not be connected with the inner wall of the mouth portion 20 leaving a narrow space between each side edge of the partitioning strip 5 and the inner wall of the mouth portion 20.

If the both side edges of the partitioning strip 5 are formed in such a manner that these side edges are press-contacted with the inner wall of the mouth portion 20, the mouth portion 20 of the liquid bottle 10 can be longitudinally partitioned and at the same time the supplemental mouthpiece can be prevented from falling out.

Moreover, if the lower portion of the partitioning strip 5 is tapered, i.e. the width thereof becoming gradually narrowed, the insertion of the partitioning strip 5 into the mouth portion 20 can be facilitated in the step of assembling.

When liquid in the liquid bottle 10 is to be poured out of the liquid bottle 10 by inclining the liquid bottle 10, the liquid passing through the mouth portion 20 impinges upon the partitioning strip 5. As a result, the pulsating motion of liquid is disturbed by the partitioning strip 5, and at the same time, any difference in liquid pressure in the liquid bottle can be minimized by the in-flow of air from the vent hole 3, hence the spouting or splashing of liquid at the moment of pouring liquid out of the liquid bottle 10 can be inhibited.

Meanwhile, the out-flow of liquid from the vent hole 3 will be obstructed by the presence of the protection piece 4.

Since the supplemental mouthpiece 1 is integrally formed inside the mouth portion 20, it is possible to close the opening of the mouth portion 20 by the engagement thereof with a cap having a male screw on its outer periphery.

Next, another embodiment wherein the supplemental mouthpiece 1 is separately prepared from the mouth portion 20 so as to be detachably mounted on the mouth portion 20 will be explained below.

Figure 3:
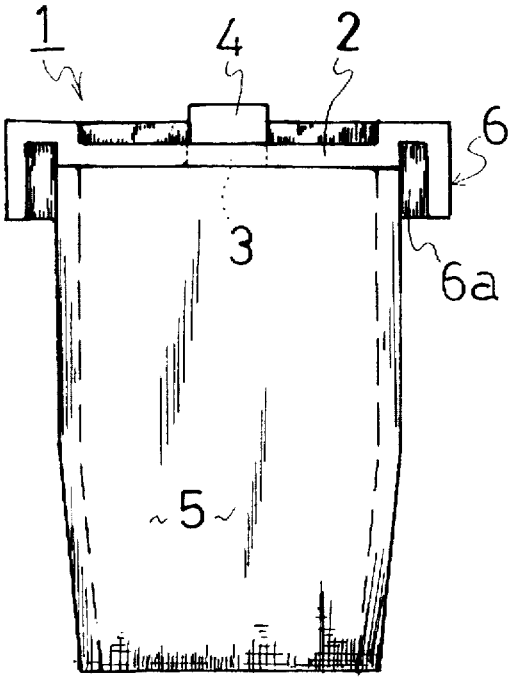
FIG. 3 is a side view of a supplemental mouthpiece for a liquid bottle according to a second embodiment of this invention.
Figure 4:
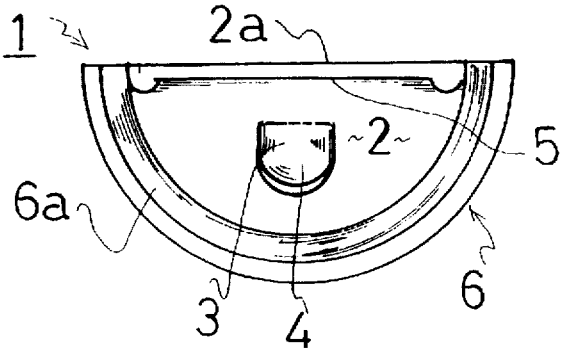
FIG. 4 is a plan view showing the top surface of the supplemental mouthpiece shown in FIG. 3.

Referring to FIGS. 3 and 4, the supplemental mouthpiece shown therein illustrates a second embodiment wherein the supplemental mouthpiece 1 is integrally formed with a securing member 6 which is adapted to be detachably mounted on the mouth portion 20 of the liquid bottle 10.

The securing member 6 is U-shaped in cross-section and is provided with a groove 6*a* to be fitted in snugly with the upper edge of the mouth portion 20. This securing member 6 is formed along the outer periphery of the cover 2.

The cover 2 shown in this example is semicircular in shape covering part of the mouth portion 20, and the securing member 6 is arched in conformity with the outer periphery of the cover 2 and fitted onto the upper edge of the mouth portion 20 so as to cover a half of the mouth portion 20.

The partitioning strip 5 is integrally formed with the cover 2 in such a manner that the partitioning strip 5 extends perpendicularly from the straight side edge 2*a* of the cover 2. Both sides of the partitioning strip 5 are thickened whereby forming a pair of reinforcing ribs 5a. The partitioning strip 5 is formed as a rectangular strip, but may be of a rectangular strip having a tapered lower portion so as to facilitate the insertion thereof into the mouth portion 20.

Alternatively, the upper portion of the partitioning strip 5 may be made slightly larger than the diameter of the mouth portion 20 so as to be restrained by the mouth portion 20. In this case, the supplemental mouthpiece 1 may be firmly attached to the mouth portion 20 by making the most of the wedging action of the upper portion of the partitioning strip 5.

Other constructions of the supplemental mouthpiece 1 may be the same as those of the previous embodiment, so that the explanations thereof are omitted by simply referring to them by the same reference numerals.

Since this supplemental mouthpiece 1 can be detachably mounted onto the mouth portion 20, the supplemental mouthpiece 1 may be mounted on the mouth portion 20 in advance, or may be mounted after the mouth portion 20 is unsealed.

The supplemental mouthpiece 1 shown in FIGS. 5 and 6 illustrates a third embodiment wherein the construction of securing member 6 is varied.

Namely, the securing member 6 is constructed by diametrically enlarging the outer periphery of the cover 2 to such an extent that the enlarged portion can be mounted on the upper edge of the mouth portion 20.

The partitioning strip 5 is integrally formed with the cover 2 in such a manner that the partitioning strip 5 extends perpendicularly from the straight side edge 2*a* (i.e. excluding the edge portion where the securing member 6 is formed) of the cover 2.

In this case, the width of the partitioning strip 5 may be made almost the same as the diameter of the mouth portion 20 so that when the supplemental mouthpiece 1 is fitted in the mouth portion 20, the partitioning strip 5 is frictionally engaged with the inner wall of the mouth portion 20 thereby allowing the supplemental mouthpiece 1 to be firmly secured to the mouth portion 20.

Alternatively, the supplemental mouthpiece 1 may be provided along the outer periphery of the cover 2 with a fitting rib 7 projecting toward the interior of the liquid bottle so that the fitting rib 7 can be frictionally fitted in the mouth portion 20 so as to fix the supplemental mouthpiece 1 in the mouth portion 20.

Instead of forming the fitting rib 7, the thickness of the cover 2 may be increased to become thicker than the thickness of the securing member 6 thereby obtaining a plug-like shape which can be inserted into the mouth portion 20.

The width of the partitioning strip 5 may be made the same as or larger than the diameter of the mouth portion 20 as mentioned above so that when the partitioning strip 5 is fitted in the mouth portion 20, the partitioning strip 5 is frictionally engaged with the inner wall of the mouth portion 20 thereby allowing the supplemental mouthpiece 1 to be firmly secured to the mouth portion 20.

Other constructions of the supplemental mouthpiece 1 may be the same as those of the previous embodiment, so that the explanations thereof are omitted by simply referring to them by the same reference numerals.

The supplemental mouthpiece 1 shown FIG. 7 illustrates a fourth embodiment wherein the construction of the securing member 6 is varied.

Namely, the securing member 6 is constructed to engage with the entire circumference of the upper edge of the mouth portion 20. Therefore, the securing member 6 is annular as a whole, the cross-section thereof being U-shaped as in the case of the second embodiment. Since this securing member 6 is formed throughout the entire circumference of the mouth portion 20, the cover 2 may be extended.

The cover 2 may be constructed to cover the entire opening of the mouth portion 20 excluding a vent hole 3 and an opening 8 for discharging the liquid from the bottle, the vent hole 3 and the opening 8 being formed in the cover 2.

The partitioning strip 5 in this case is formed integral with the middle portion of the cover 2, diametrically traversing the mouth portion 20.

Other constructions of the supplemental mouthpiece 1 may be the same as those of the previous embodiment, so that the explanations thereof are omitted by simply referring to them by the same reference numerals.

The construction of the securing member may be constructed in the same manner as explained in the third embodiment.

In the embodiments explained above, the supplemental mouthpiece is constructed such that approximately half of the mouth portion is covered by the cover. However, the open area of the mouth portion may be enlarged, i.e. minimizing the covered portion.

The partitioning strip may be of cylindrical shape integrally formed along the outer periphery of the cover so as to enhance the frictional engagement thereof with the mouth portion of the bottle, thereby preventing the supplemental mouthpiece from being drawn out.

Further, in the embodiments explained above, a liquid bottle made of PET has been exemplified. However, there is no limitation as to the kinds of liquid bottle, but any kinds of liquid bottle may be employed according to this invention as long as it is provided with a mouth portion. Of course, there is no limitation as to the kinds of liquid to be contained in the liquid bottle.

It is possible according to the supplemental mouthpiece for a liquid bottle of this invention to prevent the splashing of liquid as the liquid is poured out of the bottle owing to the provision of a partitioning strip and a vent hole at the mouth portion of the bottle, thereby making it possible to smoothly pour the liquid out of the bottle.

Furthermore, since the partitioning strip is constructed to be fitted in the mouth portion of the bottle, the supplemental mouthpiece would not be markedly protruded out of the mouth portion of the bottle, and hence a cap can be put back and mounted while leaving the supplemental mouthpiece attached to the mouth portion of the bottle.

Moreover, since the supplemental mouthpiece proposed by this invention is simple in structure, the manufacturing cost thereof would be reduced as compared with the conventional supplemental mouthpiece. Further, it is possible to advantageously apply the supplemental mouthpiece of this invention to various kinds of liquid bottle.

I claim:

1. A supplemental mouthpiece adapted to be mounted on a mouth portion of a bottle for preventing splashing of liquid on an occasion of pouring a liquid from the bottle, which comprises:

a cover which is adapted to partially close an opening of a mouth portion of the bottle;

a vent hole formed in said cover; and a partitioning strip attached to and extending perpendicularly from an edge of said cover so as to partition an interior of the mouthpiece into two passage sections, said cover being formed integrally with a securing member to be mounted on the mouth portion of the bottle, said cover being semi-circular in shape and said securing member being formed along an outer arched periphery of said cover.

2. The supplemental mouthpiece for a bottle according to claim 1, wherein said cover provided with the partitioning strip is formed integral with the mouth portion of the liquid bottle.

3. The supplemental mouthpiece for a bottle according to claim 1, wherein said cover is provided with a protection piece covering over the vent hole for prevent liquid from flowing out through the vent hole while allowing an air to pass through the vent hole.

4. The supplemental mouthpiece for a bottle according to claim 1, wherein said securing member is provided with a groove to be fitted in snugly with the upper edge of the mouthpiece of the liquid bottle.

5. A supplemental mouthpiece adapted to be mounted on a mouth portion of a bottle for preventing splashing of liquid on an occasion of pouring a liquid from the bottle, which comprises:

a cover which is adapted to partially close an opening of a mouth portion of the bottle;

a vent hole formed in said cover; and a partitioning strip attached to and extending perpendicularly from an edge of said cover so as to partition an interior of the mouthpiece into two passage sections, said cover being formed integrally with a securing member to be mounted on the mouth portion of the bottle, said cover being semi-circular in shape and said securing member being formed along an outer arched periphery of said cover, said securing member being annular in shape so as to fit snugly with the upper annular edge of the mouth portion of the bottle.

6. A supplemental mouthpiece adapted to be mounted on a mouth portion of a bottle for preventing splashing of liquid on an occasion of pouring a liquid from the bottle, which comprises:

a cover which is adapted to partially close an opening of a mouth portion of the bottle;

a vent hole formed in said cover; and a partitioning strip attached to and extending perpendicularly from an edge of said cover so as to partition an interior of the mouthpiece into two passage sections, said cover being formed integrally with a securing member to be mounted on the mouth portion of the bottle, said cover being semi-circular in shape and said securing member being formed along an outer arched periphery of said cover, said partitioning strip being mounted to longitudinally partition the mouth portion into two passage sections with both sides of said partitioning strip being press-contacted with the inner wall of said mouth portion.

7. The supplemental mouthpiece for a bottle according to claim 6, wherein a lower end portion of said partitioning strip is tapered to facilitate an insertion thereof into said mouth portion.

* * * * *